United States Patent [19]

Jones et al.

[11] 4,014,316

[45] Mar. 29, 1977

[54] SYSTEMS FOR HEATING FLUIDS

[75] Inventors: Derek Arthur Jones; Robert William Cox, both of Solihull, England

[73] Assignee: British Gas Corporation, London, England

[22] Filed: Nov. 10, 1975

[21] Appl. No.: 630,505

[52] U.S. Cl. ..... 126/360 R; 126/91 A; 431/158; 431/187; 431/351

[51] Int. Cl.[2] ..... F24H 1/28

[58] Field of Search ..... 126/360 R, 91 A; 431/158, 177, 187, 188, 351, 353

[56] References Cited

UNITED STATES PATENTS

| | | | |
|---|---|---|---|
| 2,174,515 | 10/1939 | Hughes | 431/89 |
| 2,348,767 | 5/1944 | Walker et al. | 126/360 R |
| 3,044,551 | 7/1962 | Pryor | 126/360 |
| 3,353,921 | 11/1967 | Hirt | 126/91 R |
| 3,574,508 | 4/1971 | Rothhaar et al. | 431/351 |
| 3,828,762 | 8/1974 | Duzey | 126/91 A |

*Primary Examiner*—Carroll B. Dority, Jr.
*Attorney, Agent, or Firm*—Larson, Taylor and Hinds

[57] ABSTRACT

A system for the direct firing of immersion tubes for heating of liquids in vats or tanks, including a gas burner, of the postmixer nozzle type comprising a gas supply tube having a blanked off downstream end provided with a series of peripheral gas ports, the gas tube being concentrically disposed within an air tube and having a perforated cone attached thereto slightly rearwardly of the gas ports, the arrangement being such that gas and air is entrained above atmospheric pressure and thoroughly mixed at the burner head by the turbulent flow of air through the perforated cone and around its periphery so as to create regions of gas rich and weak mixtures whereby to obtain flame stability. The system also includes a combustion chamber communicating the burner with the immersion tube.

2 Claims, 6 Drawing Figures

SYSTEMS FOR HEATING FLUIDS

This invention relates to systems for the direct firing of immersion tubes for heating fluids, e.g., liquids in vats or tanks.

Usually in systems of this kind, immersion tubes have been directly fired using natural draught burners and in order to obtain the desired rate of heat transfer from the immersion tube to the fluid in the vat or tank, the tube has of necessity required to be of large bore size.

In other systems, using indirect heating, smaller bore immersion tubes have been used to convey externally heated steam or other fluids for heating the liquid in the vat or tank at the desired rate of heat transfer, but such systems, besides being inconvenient, suffer the disadvantage of higher installation and running costs and overall inefficiency.

The main object of the present invention is to provide an improved system for the direct firing of immersion tubes, and which is less subject to the aforesaid disadvantage.

According to the present invention, a system for the direct firing of immersion tubes includes in combination, a burner having a burner head to which air and gaseous fuel (hereinafter referred to as gas) can be separately but forceably supplied and mixed at the burner head, means for igniting the combustible gas/air mixture, a chamber disposed downstream of the burner in which the gas/air mixture can be combusted, and a tube of predetermined length communicating the combustion chamber and an outlet for exhaust gases, the length of which tube between the chamber and the exhaust outlet being arranged in use of the system to be immersed in the fluid to be heated whereby the heat from the combusted gases passing through the tube can be transferred to the fluid.

The air and gas may be supplied at a pressure above atmospheric pressure, such that there is sufficient pressure in the system to enable products of combustion to discharge through the outlet to the atmosphere. Alternatively, where sufficient supply pressures are not available in a particular installation, suction may be applied to the outlet such that air is drawn into the burner from the atmosphere, gas being supplied through regulator means, for example, a zero governor. Intermediate arrangements, e.g., supply pressures at the inlet and suction at the outlet may be employed where the available gas and air pressures are limited and higher thermal outputs are required.

Preferably, the burner head comprises a gas supply tube closed at its inner end, which closed end is provided with a plurality of gas outlet ports, an air tube of greater diameter than the gas tube and disposed concentrically about it, and an annular perforate member, for example of concial form disposed substantially across the annular space defined between the outlet ends of the gas tube and the air tube with its inner peripheral edge located behind the gas outlet ports, whereby in use of the system to provide small streams of turbulent air which entrain gas from the gas outlet ports so as to produce gas-rich and gas-weak combustible mixtures.

Preferably also, the combustion chamber consists of a hollow cylindrical cavity formed in a block of refractory material, the diameter of the cavity over the greater proportion of its length being not less than the diameter of the air tube, and preferably of greater diameter, and tapering inwardly towards its end which communicates with the immersion tube.

Since the immersion tube is primarily intended for the heating of liquids (which may include molten metals) contained in vats or tanks used, for example, in food, chemical, metal and other manufacturing industries, it is preferably made of corrosion-resistant metal, e.g., stainless steel, and may be bent or formed into any suitable shape adapted for the particular application.

Preferably, the immersion tube is of small bore (that is to say, small in relation to the size of the vat or tank and the thermal input required), and of length that is calculated in use of the system to provide heat transfer to the fluid in the vat or tank at the required rate.

The differential between the air and gas supply pressures and the relatively lower combustion products pressure at the immersion tube exhaust outlet is required to be sufficient, both to overcome the pressure drop across the burner head together with the pressure drop along the immersion tube, and to annul any fluctuations in back pressure within the immersion tube which may occur under operating conditions and which tend to reduce flame stability.

Means may be provided for varying the rate of supply of the air or gas, or both to the burner, so as to enable the proportion of gas to air mixture to be selectively determined. High differential pressures across the burner head are desirable since they tend to encourage good flame stability and combustion quality.

One embodiment of the invention will now be described by way of example with reference to the accompanying diagrammatic drawings in which.

Figure 1:
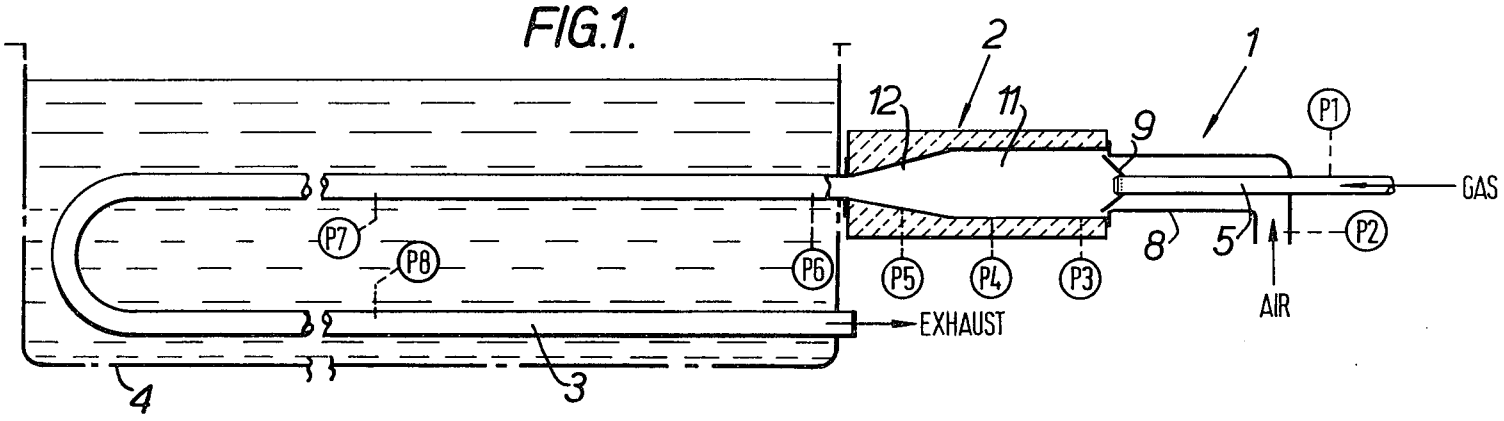
FIG. 1 is a longitudinal part sectional elevation of a system according to the invention designed for the direct firing of immersion tubes for heating liquids in tanks or vats.
Figure 2:
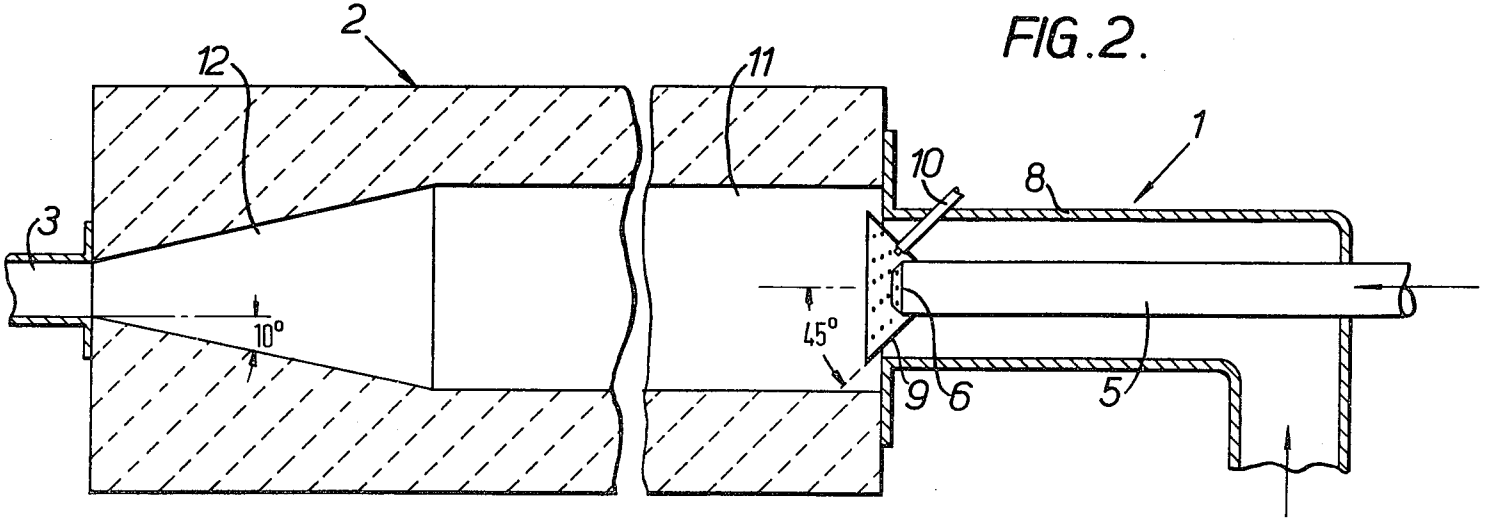
FIG. 2 is an enlarged sectional view of the burner and combustion chamber shown in FIG. 1.
Figure 3:
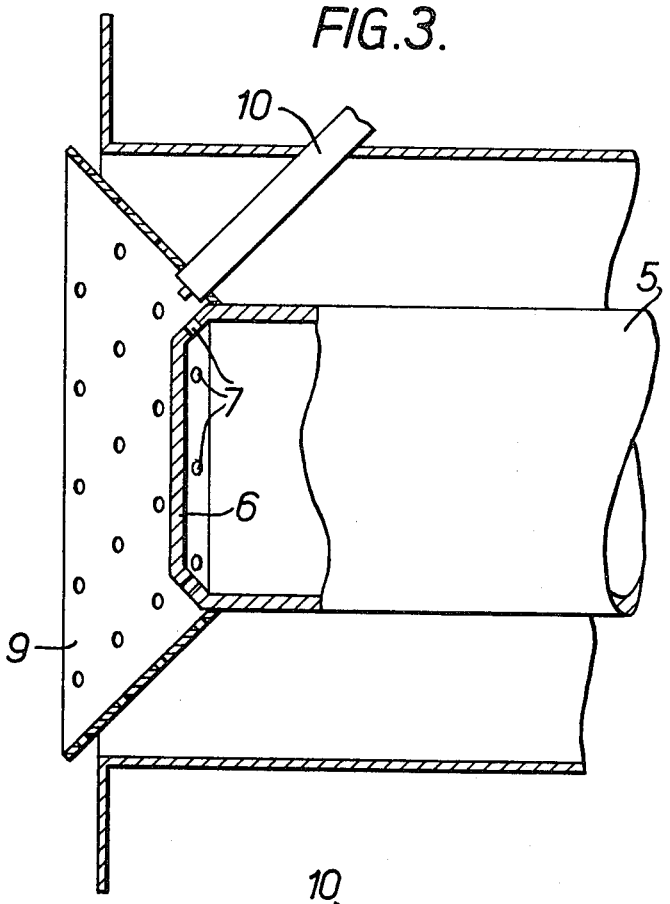
FIG. 3 is an enlarged fragmentary section of the burner head nozzle of the system.

Referring first to FIGS. 1 to 4, the system comprises a burner 1, a combustion chamber 2 and a small bore immersion tube 3 (shown schematically) which is supported within a vat 4 containing the liquid to be heated.

The burner is of a nozzle-mixing kind in which gas and air are supplied separately above atmospheric pressure and mixed at the burner head which consists of a gas supply tube 5 blanked off at the downstream end 6 which is provided with a plurality of gas outlet ports 7 spaced around the chamfered peripheral end 6 so that the ports are directed at an angle of about 45° from the axis of the gas tube 6. An air tube 8 is disposed concentrically about the gas tube 5 and a perforate cone 9 subtending an angle of revolution of about 45° to the said axis is fixed to the gas tube 5 just behind the gas ports 7 with its peripheral edge spaced slightly forwardly from the inner cylindrical surface of the air tube 8. Any suitable igniter 10 is provided at the burner head adapted in use of the system to ignite the gas/air mixture.

In use of the burner, the bulk of the air supplied by forced draught or hot gas extraction means to the tube 8 passes through the perforations in the cone 9 with a small proportion of air passing the annular space at its periphery, whereby collectively to ensure that the air flow through the tube is broken up into small turbulent streams at regions of gas flow from the ports 7 so as to create regions of gas-rich and gas-weak combustible mixtures which encourage flame stability.

The burner 1 is detachably secured by suitable means (not shown) to the rear end of the combustion chamber 2 which is also detachably secured to the inlet end of the immersion tube 3 by suitable means (not shown). The combustion chamber comprises a cylindrical refractory tunnel 11 terminating at its forward end in a conical tapered section 12 through which the combustion products pass into the immersion tube.

For enabling the burner to provide a stable flame even when firing against relatively high and fluctuating back pressures (e.g. of the order of 4 inch water gauge or more), and at high firing rates (e.g. of the order of $18 \times 10^6$ Btu/h per $ft^2$ of immersion tube cross-sectional area), it is designed to use, besides the highest pressure supply normally available, a separately provided forced air supply to the tube 8 of similar pressure, so that the pressure drop across the burner head is sufficient to annul the fluctuations in back pressure that occur in use of the system. It may also be desirable, for obtaining good combustion quality and flame stability, to provide a reasonable proportion of excess air in the gas/air mixture and this can be controlled by the pressure differential between the air duct and the combustion chamber.

Figure 4:
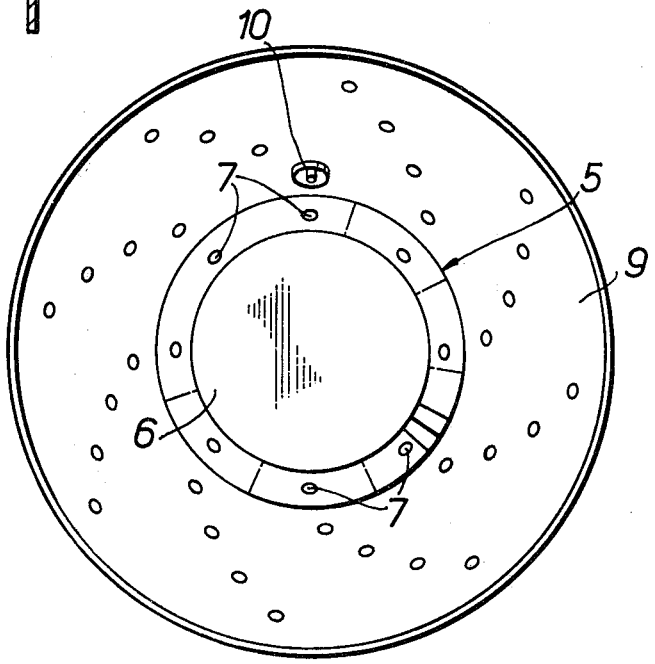
FIG. 4 is an end elevation of FIG. 2.

In a specific construction of a system according to the invention the gas tube 5 had an internal diameter of 0.8175 inch and provided with eight 0.07 inch equally spaced outlet ports 7 with the leading peripheral edge of the cone 9 extending 0.375 inch forwardly of the leading edge of the cylindrical air tube 8, so as to project into the combustion chamber 2 when fitted to it, the air tube having an inside diameter of 2.0 inches. The cone 9 was perforated with 32 holes, each of 0.125 inch diameter and arranged in any suitable orientation, e.g. of radially spiralling pattern as shown in FIG. 4.

The right cylindrical bore in the combustion chamber 2 was 8 inches in length and 3 inches in diameter and then tapered inwardly to communicate with the 1 inch bore of the immersion tube 3 which was bent into a U-shape and of total immersed length of about 20 feet, the parallel limbs of the U-shaped immersion tube being arranged horizontally.

It will be appreciated that the tube 3 could be formed in other suitable shapes, for example of coiled form, designed for the particular application consistent with the required transfer of heat to the liquid medium to be heated.

Figure 5:
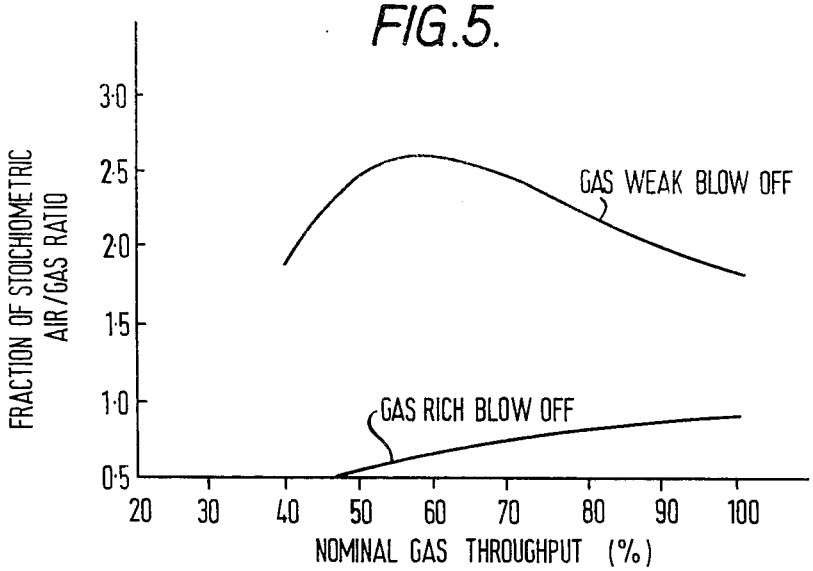
FIGS. 5 and 6 are graphs depicting operating conditions established for such a system in terms of flame stability and combustion quality respectively.
Figure 6:
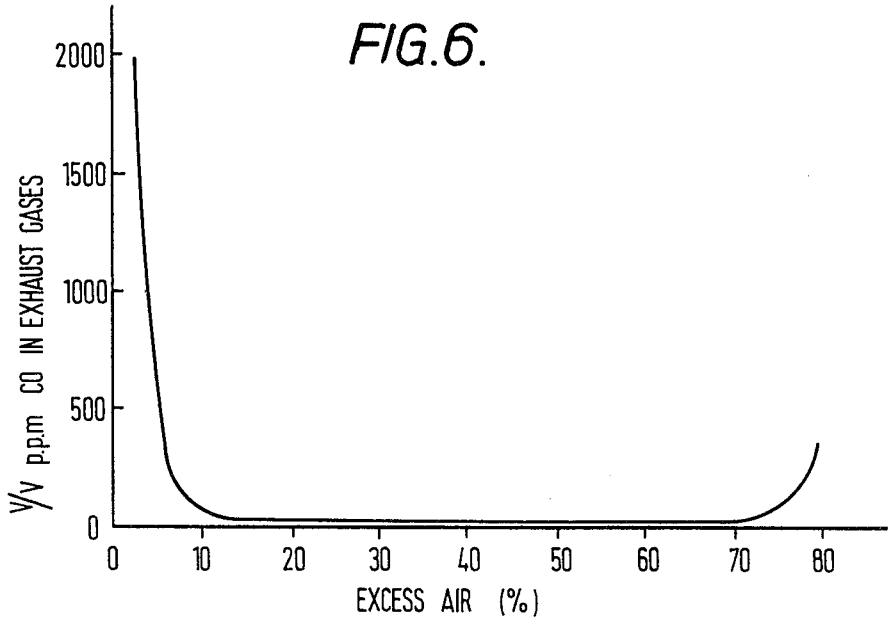

Referring in particular to FIGS. 1, 5 and 6, the operating conditions established for the specific system just described were as follows:

a. Flame Stability: (See FIG. 5). At the designed rating of 100 $ft^3$/h of natural gas supply, stable flame performance can be achieved in a range from as little below stoichiometric air/gas ratio to 85% excess air.

b. Combustion Quality: (See FIG. 6). In terms of carbon monoxide in the exhaust products against burner aeration, it was found that very low carbon monoxide levels are achieved at excess air values between 10% and 70%.

c. Pressure Distribution: (See FIG. 1). Using a 20 foot long small bore immersion tube of 1.0 inch internal diameter, the water gauge pressure readings (expressed in inches water gauge) at points P1 to P8 in the system were as follows:

| | | | | | |
|---|---|---|---|---|---|
| P1 | = | 11.4 | P5 | = | 4.2 |
| P2 | = | 7.0 | P6 | = | 3.0 |
| P3 | = | 4.4 | P7 | = | 1.2 |
| P4 | = | 4.3 | P8 | = | 0.4 |

Points P7 and P8 being situated approximately midway along the respective parallel limbs of the U-shaped immersion tube 3.

d. System Efficiency: This was found to be particularly high. For example, with a tank water temperature of 63° C, the exhaust flue temperature was 72° C using an excess air value of 28.5%. This corresponds to an efficiency rating of 88% based on the gross calorific value for the natural gas used.

A particular advantage of systems in accordance with the present invention is that they enable a much higher rate of heat transfer to be obtained than has hitherto been found possible with conventional natural draught directly fired systems, and closely similar to that obtainable with some indirect steam heated systems. For example, in the particular embodiment just described in which a 10 inch water gauge gas and air supply pressure was used, a heat input of 100,000 Btu per hour can be achieved from a 1 inch diameter immersion tube. Even higher input rates than this can be achieved if sufficiently high pressures (or suction) are available for the gas and air supply to the burner.

In other applications, according to the present invention, immersion tubes of up to 4 inches diameter (dependent on the size of the vat or tank and the required heat input) may be used. For example, a 4 inch tube would be suitable for a heating rate of 1.6 mill. Btu/h in a tank of appropriate size using similar operating conditions.

We claim:

1. Gas-fired apparatus for the direct firing of an immersion tube for heating liquid in a vat or tank, including in combination, a burner of the nozzle-mixing type having a burner head comprising a gas supply tube closed at its inner end, the closed end of the gas tube being provided with equally spaced gas outlet ports inclined at an angle of between 40° and 50° to the tube axis, an air tube of greater diameter than the gas tube and disposed concentrically about it, and an annular perforate member of conical form substanting an angle of revolution of between 40° and 50° and fixed to said gas tube behind said gas outlet ports with its outer peripheral edge spaced slightly forwardly from the inner cylindrical surface of said air tube so as to project into said combustion chamber, disposed substantially across the annular space defined between the outlet ends of the gas and air tubes with its inner peripheral edge located behind the gas outlet ports, means for supplying air and gas separately to the burner head above atmospheric pressure, means for igniting a combustible gas/air mixture adjacent said burner head, a combustion chamber disposed downstream of the burner external to the vat or tank, the combustion chamber consisting of a hollow cylindrical cavity formed in a block of refractory material, the diameter of the cavity over the greater proportion of its length being greater than the diameter of the air tube and tapering inwardly towards its end which communicates with the immersion tube, and an immersion tube for immersion in a liquid to be heated, said immersion tube being of small bore and of predetermined length and communicating the combustion chamber and an outlet for exhaust gases.

2. Gas-fired apparatus according to claim 1, wherein the inwardly tapering portion of the chamber cavity subtends an angle of about 10°.

* * * * *